US011446705B2

(12) United States Patent
Maynard

(10) Patent No.: US 11,446,705 B2
(45) Date of Patent: Sep. 20, 2022

(54) DUST AND PARTICLE SEPARATOR WITH VORTICAL ACTION

(71) Applicant: Donald Maynard, East Lansing, MI (US)

(72) Inventor: Donald Maynard, East Lansing, MI (US)

( * ) Notice: Subject to any disclaimer, the term of this patent is extended or adjusted under 35 U.S.C. 154(b) by 25 days.

(21) Appl. No.: 16/925,395

(22) Filed: Jul. 10, 2020

(65) Prior Publication Data

US 2021/0008595 A1 Jan. 14, 2021

Related U.S. Application Data

(60) Provisional application No. 62/873,492, filed on Jul. 12, 2019.

(51) Int. Cl.

| | |
|---|---|
| ***B07B 4/06*** | (2006.01) |
| ***B07B 9/00*** | (2006.01) |
| ***B03C 7/00*** | (2006.01) |

(52) U.S. Cl.

CPC ..... *B07B 4/06* (2013.01); *B03C 7/00* (2013.01); *B07B 9/00* (2013.01)

(58) Field of Classification Search

CPC .... B07B 4/06; B07B 9/00; B03C 7/00; B04C 5/04; B04C 5/14; B04C 5/08; B04C 5/185; B04C 5/187

See application file for complete search history.

(56) References Cited

U.S. PATENT DOCUMENTS

| | | | | |
|---|---|---|---|---|
| 4,133,658 | A | 1/1979 | Callewyn | |
| 5,080,697 | A * | 1/1992 | Finke | A47L 9/108 15/353 |
| 6,833,016 | B2 * | 12/2004 | Witter | B01D 50/002 451/88 |
| 7,282,074 | B1 * | 10/2007 | Witter | B01D 45/12 451/453 |
| 8,393,050 | B2 * | 3/2013 | Witter | B04C 5/185 15/353 |
| 9,161,668 | B2 * | 10/2015 | Quance | A47L 9/1666 |
| 2006/0102005 | A1 * | 5/2006 | Oh | A47L 9/0081 96/385 |
| 2015/0224514 | A1 | 8/2015 | Mercado | |
| 2019/0030547 | A1 | 1/2019 | Kuhlmann | |
| 2019/0134649 | A1 | 5/2019 | Witter et al. | |
| 2019/0168422 | A1 | 6/2019 | Hofmann et al. | |

* cited by examiner

*Primary Examiner* — Patrick H Mackey

(74) *Attorney, Agent, or Firm* — Blue Filament Law PLLC

(57) ABSTRACT

A particle separator is provided for separating small particles from large particles from material. The particle separator includes a conical shaped separator housing that forms a cyclonic separator enclosure, a cover attached at a top portion of the cyclonic separator enclosure, and an opening at a bottom portion of the cyclonic separator enclosure. The cyclonic separator enclosure has an inlet tube with a tangential entry opening along an inner wall of the cyclonic separator enclosure, where the inlet tube projects horizontally outward from an upper portion of the cyclonic separator enclosure. An outlet tube extends upward from a center of the cover with a vacuum unit connected to the outlet tube that creates a vortex in the cyclonic separator enclosure.

32 Claims, 5 Drawing Sheets

DUST AND PARTICLE SEPARATOR WITH VORTICAL ACTION

RELATED APPLICATIONS

This application claims priority benefit of U.S. Provisional Application Ser. No. 62/873,492 filed 12 Jul. 2019, the contents of which are hereby incorporated by reference.

FIELD OF THE INVENTION

The present invention in general relates to a particle separator and in particular to a vortical separator to selectively allow smaller dust particulate to pass through a screen mesh into a vacuum canister, while larger particulate is collected and deposited into a holding container.

BACKGROUND OF THE INVENTION

Thermoplastic molding produces sprues and other pieces of scrap thermoplastic material in the course of molding articles. Rather than discard this scrap material, it is conventional to the art to grind such scrap into comparatively uniform sized particulate amountable to intermixing with virgin thermoplastic pellets for reprocessing through the molding process. Unfortunately, it is common that debris becomes intermixed with the pelletized thermoplastic scrap. Such debris can compromise the quality of a molded article through creation of an inhomogeneity. This problem is especially severe when molding transparent articles in which debris can form a visually discernible inclusion. Further, depending on the processing conditions and the nature of the debris, charring of the debris can occur resulting in a visually discernable black inclusion.

Cyclonic separation is a method of removing particulates from an air, gas, and a mixed material or liquid stream through vortex separation. Rotational effects and gravity are used to separate mixtures of solids and fluids, or differing sized particulate. The method can also be used to separate fine droplets of liquid from a gaseous stream.

A high speed rotating (air) flow is established within a cylindrical or conical container called a cyclone. Air flows in a helical pattern, beginning at the top (wide end) of the cyclone and ending at the bottom (narrow) end before exiting the cyclone in a straight stream through the center of the cyclone and out the top. Larger (denser) particles in the rotating stream have too much inertia to follow the tight curve of the stream, and thus strike the outside wall, then fall to the bottom of the cyclone where the larger particles can be removed. In a conical system, as the rotating flow moves towards the narrow end of the cyclone, the rotational radius of the stream is reduced, thus separating smaller and smaller particles. The cyclone geometry, together with volumetric flow rate, defines the cut point of the cyclone. This is the size of particle that will be removed from the stream with a 50% efficiency. Particles larger than the cut point will be removed with a greater efficiency, and smaller particles with a lower efficiency as they separate with more difficulty or can be subject to re-entrainment when the air vortex reverses direction to move in direction of the outlet.

Furthermore, unwanted foreign spurious metal shavings or particulate may be introduced to molding materials due to mechanical wear of processing machinery. The introduction of metal shavings may also have adverse effects on the molding material properties, performance, and surface finish.

In response to the problems associated with debris becoming entrained with a regrind particle stream or indeed a virgin thermoplastic particle stream, the separators are conventionally used to remove such debris.

An additional advantage of introducing a cyclonic separation unit in a vacuum system is to avoid the clogging of the vacuum and the vacuums filters with particulate when vacuuming materials. The large particulate matter is collected in a separate collection container, while only fine particulate or dust goes into the vacuum.

Thus, there exists a need for a particle separator that achieves high throughput separation of particulate from debris and fine particulate, and does so without clogging a vacuum unit.

SUMMARY OF THE INVENTION

A particle separator is provided for separating small particles from large particles from material. The particle separator includes a conical shaped separator housing that forms a cyclonic separator enclosure, a cover attached at a top portion of the cyclonic separator enclosure, and an opening at a bottom portion of the cyclonic separator enclosure. The cyclonic separator enclosure has an inlet tube with a tangential entry opening along an inner wall of the cyclonic separator enclosure, where the inlet tube projects horizontally outward from an upper portion of the cyclonic separator enclosure. An outlet tube extends upward from a center of the cover with a vacuum unit connected to the outlet tube that creates a vortex in the cyclonic separator enclosure.

A method of operating the particle separator as described above includes a connecting a vacuum unit to the outlet tube, and activating the vacuum unit to create a vortex in the cyclonic separator enclosure. Subsequently, particulate material is fed to the cyclonic separator enclosure via the inlet tube, and large particulate is collected from a collection canister or bin.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DESCRIPTION OF THE INVENTION

The present invention has utility as a separator of small particulate from large particulate from an intermixed material feed. The present invention finds particular utility in the field of separation of thermoplastic regrind particulate from intermixed debris which constitutes a smaller particulate relative to the thermoplastic regrind. Embodiments of the inventive separator use cyclonic separation and a mesh filter within the conical separation chamber to collect small particulate within the vacuum, while larger particles are collected in a bin. The use of the inventive separator prolongs the interval for a required change of a vacuum filter. It is noted that traditional fiber filters only function for two to four hours without clogging, whereas a vacuum system utilizing an inventive embodiment of the separator have processed more than 12000 lbs. of material without fail.

Attributes particularly beneficial to the inventive separator include compact footprint and the ability to separate through the use of rotation and gravitational forces. In a specific inventive embodiment the mesh filter within the conical separation chamber may be electrically isolated and carries an electrical charge to function as an electrostatic precipitator. An electrostatic precipitator is a device that removes suspended dust particles from a gas or exhaust by applying a high-voltage electrostatic charge and collecting the particles on charged plates.

Figure 1:
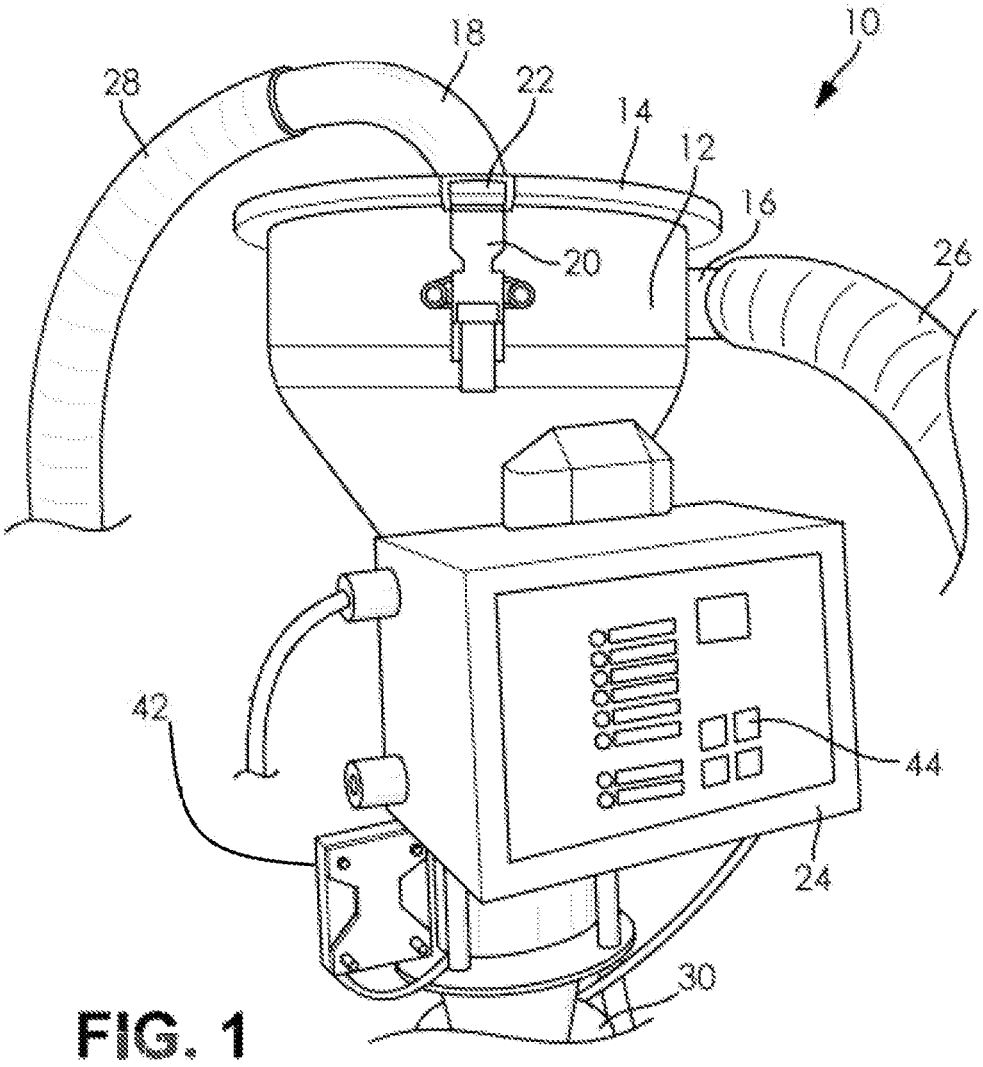
FIG. 1 illustrates an overall system view of an embodiment of an inventive vortical particle separator.
Figure 2:
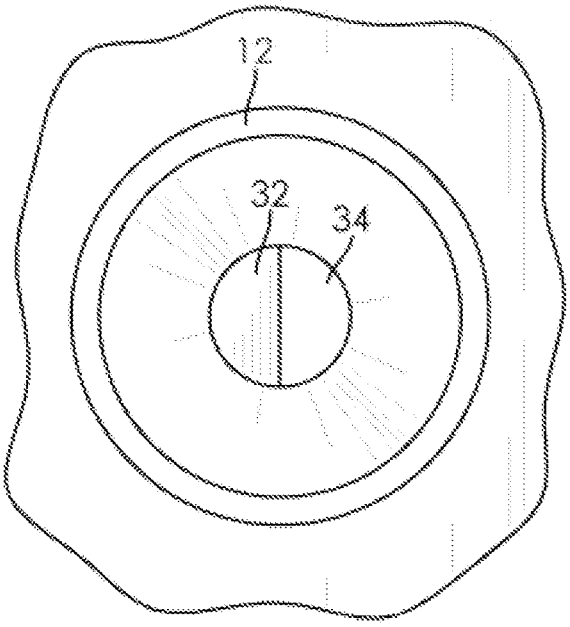
FIG. 2 is a top down view looking into a conical separation chamber in accordance with an embodiment of the invention.
Figure 3:
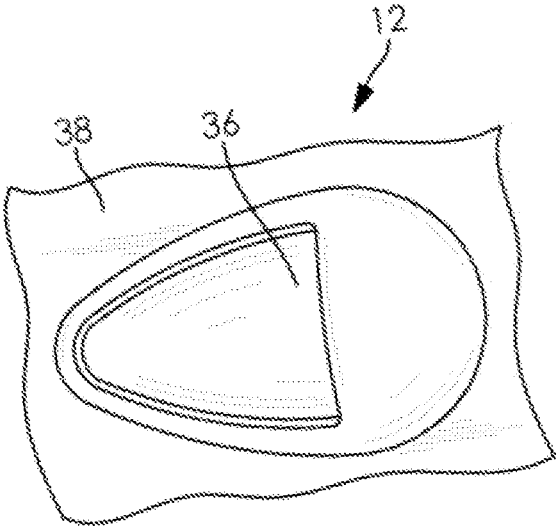
FIG. 3 illustrates a view of an injection port on the wall of the conical separation chamber of FIG. 2 in accordance with an embodiment of the invention.

With reference to the attached figures, and in particular FIG. 1, an inventive particle separator is depicted generally at 10. The separator 10 includes a housing or cyclonic separator enclosure 12 having a cover 14. The cyclonic separator enclosure 12 has an inlet tube 16 that projects horizontally outward from the upper portion of the cyclonic separator enclosure 12. The proximal end of the inlet tube 16 serves as an attachment point for the proximal end of an intake hose 26. The distal end of the intake hose 26 is positioned at the source of the material to be separated. A distal end of the inlet tube 16 has a tangential entry opening 36 along the inner wall 38 of the cyclonic separator enclosure 12 as may be seen in FIG. 3. The tangential entry opening 36 introduces material to be separated in the vectoral direction of the airflow in the cyclonic separator enclosure 12 at the surface of the inner wall 38. The separator enclosure 12 is readily formed of conventional materials including sheet metal, plastics, wood, and combinations thereof. Optionally, part or all of the separator enclosure 12 is transparent to allow for quick visual inspection as to the operation of the inventive separator 10. The height of the separator enclosure 12 may range between 6 to 24 inches, and more preferably 12 to 18 inches, and still more preferably a height of approximately 14 to 16 inches. The upper diameter of the separator enclosure 12 may range between 6 and 24 inches. FIG. 2 is a view looking downward into the separator enclosure 12 that shows a ledge 32 that divides the opening 34 in half and deflects the larger particulate downward into a collection funnel that feeds into a collection container or bin 30. A controller 24, as shown in FIG. 1, adjusts operating parameters such as intake flow rates, vacuum pressure, and feed rates. In a specific inventive embodiment, the controller 24 operates an electric eye 42 that determines the level of collected large particulate, and releases the large particulate from the collection funnel into the collection container or bin 30. Alternatively in a specific embodiment a pad switch 44 releases the large particulate from the collection funnel into the collection container or bin 30.

Figure 5:
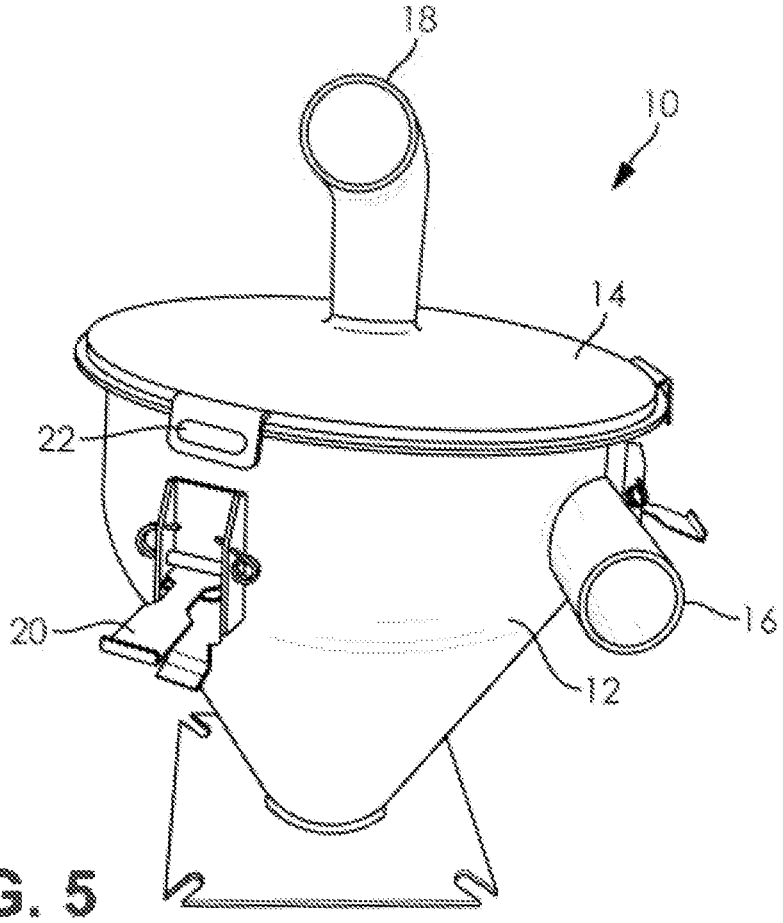
FIG. 5 illustrates a view of the embodiment of the inventive vertical particle separator of FIG. 1 with the hoses and control unit removed, and the conical separation chamber removed from the collection bin.

As best shown in FIG. 5 a set of latches or clasps 20 on the separator enclosure 12 engage a corresponding set of loops 22 on the cover 14 to provide an airtight and secure connection between the cover 14 and the top of the separator enclosure 12. An outlet tube 18 extends upward from the center of the cover 14. As shown in FIG. 1 a vacuum hose 28 attaches to the outlet tube 18. The vacuum hose 28 is connected to a vacuum unit (not shown).

Figure 4:
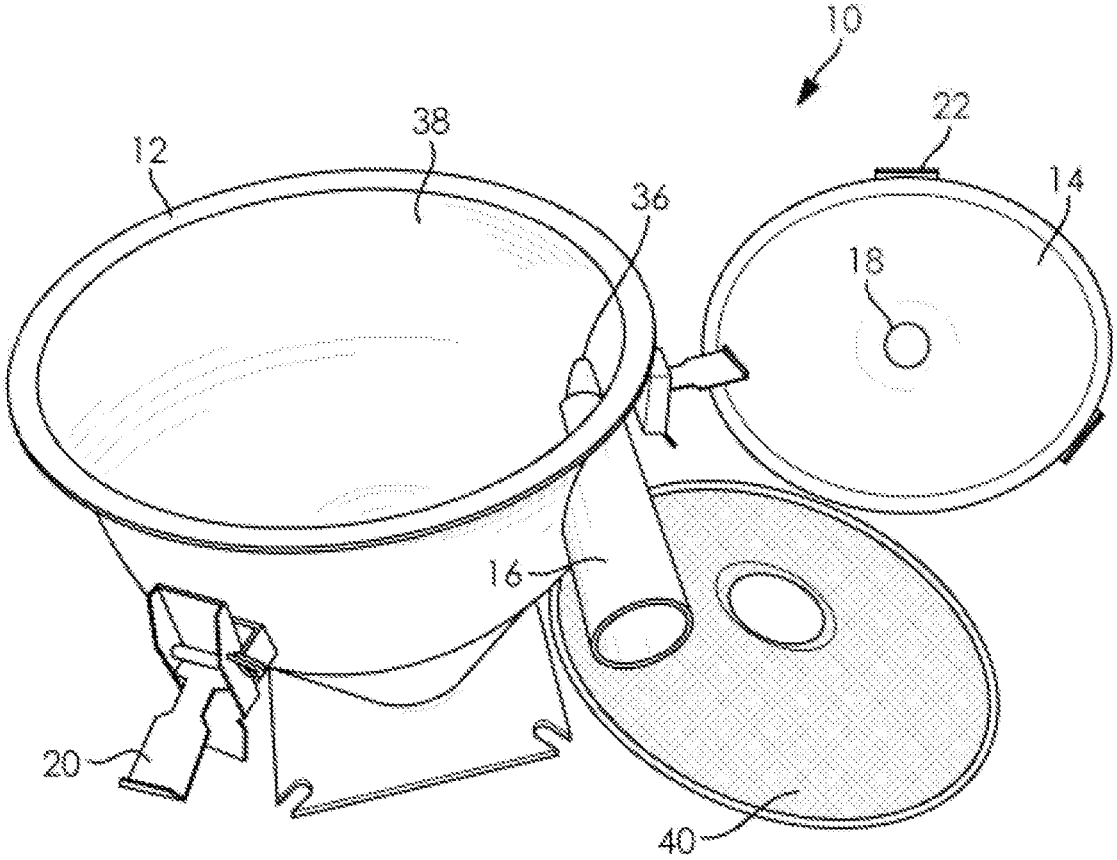
FIG. 4 illustrates a view of a disassembled embodiment of the inventive vortical particle separator.

FIG. 4 illustrates a disassembled view of the inventive vortical particle separator 10 with the cover 14 removed and a disc shaped mesh filter 40 removed from the upper region of the separator enclosure 12 that is positioned above the tangential entry opening 36 of the inlet tube 16. The mesh of the filter 40 is sized so as to only allow small particulate to exit through the outlet tube 18 and to proceed through the vacuum hose 28 to a vacuum canister. In a specific inventive embodiment, the disc shaped mesh filter 40 within the conical separation enclosure 12 may be electrically isolated and carries an electrical charge to function as an electrostatic precipitator.

In operation a vacuum unit supplies suction through the outlet tube 18 that creates a vortex in the separator enclosure 12. Particulate material in sucked into the separator enclosure 12 via the inlet tube 16 where the vacuum created vortex within the separator enclosure 12 separates the particulate by size, with the larger particulate dropping into a collection canister or bin, and the smaller particulate proceeding upward through the mesh filter 40 and into the vacuum canister or bag.

The foregoing description is illustrative of particular embodiments of the invention, but is not meant to be a limitation upon the practice thereof. The following claims, including all equivalents thereof, are intended to define the scope of the invention.

The invention claimed is:

1. A particle separator for separating small particles from large particles from material comprising:

a conical shaped separator housing that forms a cyclonic separator enclosure;

a cover attached at a top portion of said cyclonic separator enclosure;

an inlet tube with a tangential entry opening along an inner wall of said cyclonic separator enclosure, and where said inlet tube projects horizontally outward from an upper portion of said cyclonic separator enclosure;

an outlet tube extending upward from a center of said cover;

a vacuum unit connected to said outlet tube that creates a vortex in said cyclonic separator enclosure; and an opening at a bottom portion of said cyclonic separator enclosure, where said opening at the bottom portion of said cyclonic separator enclosure has a ledge that divides said opening in half and deflects the larger particulate downward into a collection funnel that feeds into a collection container or bin.

2. The separator of claim 1 further comprising a set of latches or clasps on said cyclonic separator enclosure configured to engage a corresponding set of loops on said cover to provide an airtight and secure connection between said cover and the said cyclonic separator enclosure.

3. The separator of claim 1 further comprising a mesh filter positioned above said tangential opening in said cyclonic separator enclosure.

4. The separator of claim 3 wherein said mesh filter has a mesh size such that the small particulate has a small particle dimension less than the mesh size so as to pass through said mesh and leaving the larger particulate with a large particulate dimension larger than the mesh size within said mesh.

5. The separator of claim 3 wherein said mesh filter has a disc shape.

6. The separator of claim 3 wherein said mesh screen is electrically isolated and carries an electrical charge to function as an electrostatic precipitator.

7. The separator of claim 1 further comprising a controller that adjusts operating parameters.

8. The separator of claim 7 wherein the operating parameters comprise intake flow rates, vacuum pressure, and feed rates.

9. The separator of claim 1 wherein said conical shaped separator housing is part or all transparent.

10. The separator of claim 1 wherein said conical shaped separator housing is formed from one or more of sheet metal, plastics, wood, and combinations thereof.

11. The separator of claim 1 wherein said conical shaped separator housing has a height between about 6 to about 24 inches.

12. The separator of claim 1 wherein said conical shaped separator housing has a height between about 12 to about 18 inches.

13. The separator of claim 1 wherein said conical shaped separator housing has a height between about 14 to about 16 inches.

14. The separator of claim 1 wherein a portion of said inlet tube that projects horizontally outward from the upper portion of the cyclonic separator enclosure is connected to a proximal end of an intake house and a distal end of the intake hose is positioned at a source of a material to be separated.

15. The separator of claim 1 wherein said vacuum unit is connected to said outlet tube via a hose.

16. A particle separator for separating small particles from large particles from material comprising:

- a conical shaped separator housing that forms a cyclonic separator enclosure;
- a cover attached at a top portion of said cyclonic separator enclosure;
- an inlet tube with a tangential entry opening along an inner wall of said cyclonic separator enclosure, and where said inlet tube projects horizontally outward from an upper portion of said cyclonic separator enclosure;
- an outlet tube extending upward from a center of said cover;
- a vacuum unit connected to said outlet tube that creates a vortex in said cyclonic separator enclosure;
- an opening at a bottom portion of said cyclonic separator enclosure; and
- a controller that adjusts operating parameters, where said controller operates an electric eye that determines a level of collected large particulate, and releases the large particulate from a collection funnel into a collection container or bin.

17. The separator of claim 16 further comprising a set of latches or clasps on said cyclonic separator enclosure configured to engage a corresponding set of loops on said cover to provide an airtight and secure connection between said cover and the said cyclonic separator enclosure.

18. The separator of claim 16 further comprising a mesh filter positioned above said tangential opening in said cyclonic separator enclosure.

19. The separator of claim 16 wherein the operating parameters comprise intake flow rates, vacuum pressure, and feed rates.

20. The separator of claim 16 wherein said conical shaped separator housing is part or all transparent.

21. The separator of claim 16 wherein said conical shaped separator housing has a height between about 6 to about 24 inches.

22. The separator of claim 16 wherein a portion of said inlet tube that projects horizontally outward from the upper portion of the cyclonic separator enclosure is connected to a proximal end of an intake house and a distal end of the intake hose is positioned at a source of a material to be separated.

23. The separator of claim 16 wherein said vacuum unit is connected to said outlet tube via a hose.

24. A particle separator for separating small particles from large particles from material comprising:

- a conical shaped separator housing that forms a cyclonic separator enclosure;
- a cover attached at a top portion of said cyclonic separator enclosure;
- an inlet tube with a tangential entry opening along an inner wall of said cyclonic separator enclosure, and where said inlet tube projects horizontally outward from an upper portion of said cyclonic separator enclosure;
- an outlet tube extending upward from a center of said cover;
- a vacuum unit connected to said outlet tube that creates a vortex in said cyclonic separator enclosure;
- an opening at a bottom portion of said cyclonic separator enclosure; and
- a controller that adjusts operating parameters, where said controller operates a pad switch that releases the large particulate from a collection funnel into a collection container or bin.

25. The separator of claim 24 further comprising a set of latches or clasps on said cyclonic separator enclosure configured to engage a corresponding set of loops on said cover to provide an airtight and secure connection between said cover and the said cyclonic separator enclosure.

26. The separator of claim 24 further comprising a mesh filter positioned above said tangential opening in said cyclonic separator enclosure.

27. The separator of claim 24 wherein the operating parameters comprise intake flow rates, vacuum pressure, and feed rates.

28. The separator of claim 24 wherein said conical shaped separator housing is part or all transparent.

29. The separator of claim 24 wherein said conical shaped separator housing is formed from one or more of sheet metal, plastics, wood, and combinations thereof.

30. The separator of claim 24 wherein said conical shaped separator housing has a height between about 6 to about 24 inches.

31. The separator of claim 24 wherein a portion of said inlet tube that projects horizontally outward from the upper portion of the cyclonic separator enclosure is connected to a proximal end of an intake house and a distal end of the intake hose is positioned at a source of a material to be separated.

32. The separator of claim 24 wherein said vacuum unit is connected to said outlet tube via a hose.

* * * * *